US012398625B1

(12) United States Patent
Alrashed et al.

(10) Patent No.: US 12,398,625 B1
(45) Date of Patent: Aug. 26, 2025

(54) TELESCOPING LASER SYSTEM FOR SUBSURFACE PERFORATION

(71) Applicant: SAUDI ARABIAN OIL COMPANY, Dhahran (SA)

(72) Inventors: Ahmed Ali Alrashed, Dhahran (SA); Sameeh Issa Batarseh, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/643,802

(22) Filed: Apr. 23, 2024

(51) Int. Cl.
*E21B 43/112* (2006.01)
*E21B 47/135* (2012.01)

(52) U.S. Cl.
CPC ..... *E21B 43/112* (2013.01); *E21B 47/135* (2020.05)

(58) Field of Classification Search
CPC ..... E21B 43/112; E21B 7/15; E21B 47/135; B23K 26/0869; B23K 26/382; B23K 26/0648
See application file for complete search history.

(56) References Cited

U.S. PATENT DOCUMENTS

| | | | | |
|---|---|---|---|---|
| 4,227,582 | A | 10/1980 | Price | |
| 8,307,900 | B2 | 11/2012 | Lynde et al. | |
| 8,678,087 | B2 | 3/2014 | Schultz et al. | |
| 8,807,218 | B2 * | 8/2014 | Kleefisch | E21B 43/11 219/121.84 |
| 10,199,798 | B2 | 2/2019 | Faircloth et al. | |
| 10,941,618 | B2 * | 3/2021 | Batarseh | E21B 17/1078 |
| 10,968,736 | B2 * | 4/2021 | Batarseh | E21B 47/135 |
| 11,359,438 | B2 * | 6/2022 | Batarseh | E21B 7/20 |
| 11,619,097 | B2 * | 4/2023 | Batarseh | E21B 7/14 175/16 |
| 11,739,616 | B1 * | 8/2023 | Batarseh | E21B 47/135 175/16 |
| 11,753,915 | B2 * | 9/2023 | Batarseh | E21B 43/2405 219/121.11 |
| 2004/0256103 | A1 | 12/2004 | Batarseh | |
| 2006/0102343 | A1 * | 5/2006 | Skinner | B23K 26/082 166/57 |

(Continued)

FOREIGN PATENT DOCUMENTS

| | | | | |
|---|---|---|---|---|
| CN | 111173444 A | * | 5/2020 | E21B 3/02 |
| CN | 116537702 A | * | 8/2023 | |
| WO | 2019241454 A1 | | 12/2019 | |

OTHER PUBLICATIONS

PCT International Search Report & Written Opinion pertaining to International Application No. PCT/US2025/023816; Date of Mailing: Jun. 12, 2025.

*Primary Examiner* — Jennifer H Gay
(74) *Attorney, Agent, or Firm* — Vorys, Sater, Seymour and Pease LLP

(57) ABSTRACT

A system for performing subsurface laser perforation includes a tubing deployed within a wellbore including a target layer for perforation, the tubing in communication with a surface location, and a slim laser subsurface tool operatively coupled to the tubing, the laser subsurface tool including a body coupled to the tubing, a telescoping laser head disposed within the body and including a plurality of nested segments, a smallest of the plurality of nested segments defining an orifice at an output end of the telescoping laser head, and a lens supported by the smallest of the plurality of nested segments and covering the orifice at the output end.

20 Claims, 5 Drawing Sheets

(56) References Cited

U.S. PATENT DOCUMENTS

| | | | | |
|---|---|---|---|---|
| 2013/0000906 | A1* | 1/2013 | Schultz | E21B 29/06 166/387 |
| 2013/0037268 | A1* | 2/2013 | Kleefisch | E21B 43/11 166/55.1 |
| 2014/0360778 | A1 | 12/2014 | Batarseh | |
| 2015/0129203 | A1* | 5/2015 | Deutch | E21B 43/11 166/250.1 |
| 2019/0353032 | A1* | 11/2019 | Batarseh | E21B 7/15 |
| 2020/0048966 | A1* | 2/2020 | Batarseh | E21B 7/15 |
| 2020/0048967 | A1* | 2/2020 | Batarseh | E21B 47/002 |
| 2020/0115962 | A1* | 4/2020 | Batarseh | E21B 41/0078 |
| 2021/0164294 | A1* | 6/2021 | Batarseh | E21B 17/1078 |
| 2021/0372252 | A1* | 12/2021 | Batarseh | E21B 43/26 |
| 2022/0372822 | A1* | 11/2022 | Batarseh | E21B 7/14 |

* cited by examiner

TELESCOPING LASER SYSTEM FOR SUBSURFACE PERFORATION

FIELD OF THE DISCLOSURE

The present disclosure relates generally to subsurface perforation operations and, more particularly, to systems and methods for laser perforation within oil and gas wellbores.

BACKGROUND OF THE DISCLOSURE

In oil and gas operations, perforation is the process of opening a subsurface channel between a drilled wellbore and a target hydrocarbon-bearing formation. Subsurface perforation involves piercing through a wellbore's metal casing and any cement sheaths surrounding the casing to establish connectivity with the target formation. Conventional casing perforation techniques include abrasive perforation, in which slurries including abrasive particles are jetted against the casing, and jet perforation, in which shaped, explosive charges pierce through the casing. While jet perforation may be commonly used, there are several drawbacks associated with this technique. For example, the explosive fracturing may create a low-permeability zone around the perforated area due to compaction or grain fragmentation induced by the explosion. Further, the use of explosives involves cumbersome logistical and safety protocols that must be followed to reduce the risk of misfiring the charges.

An alternative to the conventional perforation methods includes the use of high-powered lasers to penetrate through the wellbore casing and cement sheaths. The high-powered lasers can be aimed at the target layer (including metal casing, cement, and/or rock), and the electromagnetic energy of the laser may be absorbed by the target layer. During absorption, the electromagnetic energy may be transformed into thermal energy such that the laser beam induces a temperature surge in the target layer, thereby melting and/or vaporizing the surface of the target layer.

In laser perforation operations, a purging gas (commonly nitrogen) may be pumped in the path of the laser beam to cool the downhole components and to clear a pathway for the laser beam through any medium present within the wellbore. This purging process may further minimize absorption of the beam's energy by the medium through which the beam travels, thus ensuring efficient power delivery to the target. Laser power losses may vary, depending on the medium filling the wellbore. In the case that brine or water are used as a downhole wellbore fluid, the reduction in the laser beam power is estimated to be around 33% per inch. Therefore, a high pumping rate of the purging fluid may need to be continuously maintained to minimize this power reduction. Even with high pumping rates, however, significant laser power loss may occur when the distance the laser beam travels through the medium to the target layer is large enough. In these cases, the laser energy delivered to the target may be minimal and the use of laser perforation may be inviable.

Accordingly, a system is desirable for reducing laser power loss across large distances within a wellbore to be perforated.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a system for performing subsurface laser perforation includes a tubing deployed within a wellbore including a target layer for perforation, the tubing in communication with a surface location, and a slim laser subsurface tool operatively coupled to the tubing, the laser subsurface tool including a body coupled to the tubing, a telescoping laser head disposed within the body and including a plurality of nested segments, a smallest of the plurality of nested segments defining an orifice at an output end of the telescoping laser head, and a lens supported by the smallest of the plurality of nested segments and covering the orifice at the output end.

In another embodiment, a method for subsurface laser perforation includes deploying, via a tubing, a slim laser subsurface tool within a wellbore including a target layer to be perforated, extending a telescoping laser head from a body of the slim laser subsurface tool towards the target layer within the wellbore to generate a reduced clearance between a lens supported at an output end of the telescoping laser head, activating a laser source to transmit a laser beam through the body, telescoping laser head, and lens, perforating the target layer with the laser beam transmitted through the lens and across the reduced clearance, and purging a pathway across the reduced clearance by discharging a purging fluid through one or more purging nozzles defined in the telescoping laser head.

In a further embodiment, a slim laser subsurface tool for laser perforation in a wellbore includes a body for coupling to a tubing extendable within the wellbore, and a telescoping laser head selectively extendable from the body and operable to receive and output a laser beam, the telescoping laser head including a plurality of nested segments movable with respect to the body to extend and retract the telescoping laser head, a lens disposed at an output end of the telescoping laser head defined in a smallest one of the plurality of nested segments, and one or more purging nozzles disposed at the output end and operable to receive a purging fluid and to discharge the purging fluid in front of the lens.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
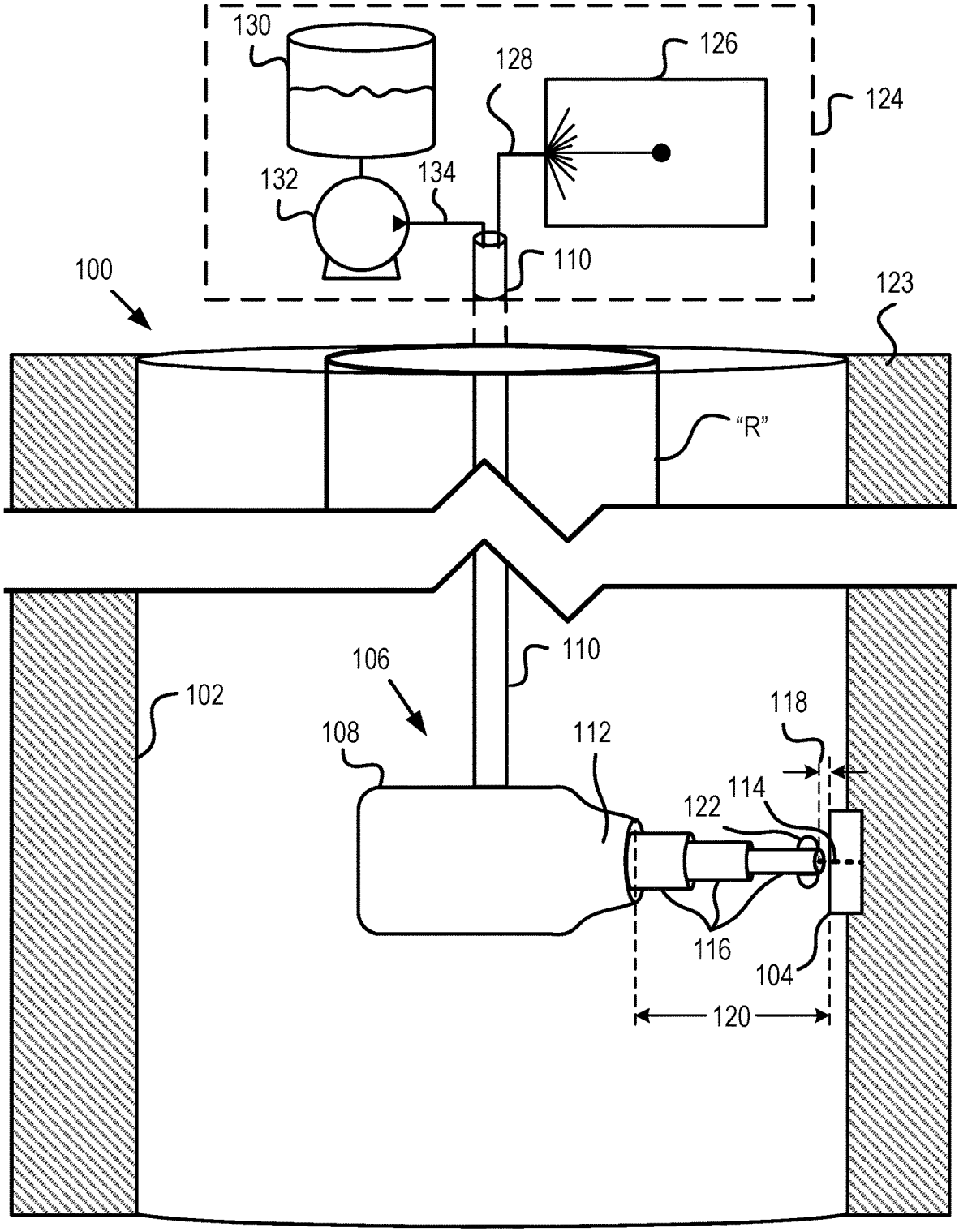
FIG. 1 is a schematic side view of a system for performing subsurface laser perforation operations with a subsurface laser tool in a wellbore, according to at least one embodiment of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to subsurface perforation operations and, more particularly, to systems and methods for laser perforation within oil and gas wellbores. The systems, apparatus, and methods described herein may utilize a slim laser subsurface tool including a telescoping laser head. As used herein, a "slim" laser subsurface tool may refer to tools having a reduced diameter with respect to a target layer circumscribing the slim tool. For example, a "slim" laser subsurface tool may have a 2 inch diameter and be used to perforate a targeted pipe with a 5 inch inner diameter. The slim laser subsurface tool be able to pass through a 2½ inch restriction or opening above the targeted pipe, for example, but will be spaced by a substantial 1½ inch clearance once arriving at the targeted pipe. The telescoping laser head may be extended to reduce the clearance between the slim laser subsurface tool and a target layer to be perforated.

The telescoping laser head may include a plurality of nested segments, and the smallest of the nested segments may include a lens and one or more purging nozzles at an output end thereof. The lens may seal the telescoping laser head and the one or more purging nozzles may emit a purging fluid to clear a path for the laser beam. The telescoping laser head may be hydraulically or pneumatically operated using the purging fluid emitted by the one or more purging nozzles. The purging fluid may fill the telescoping laser head to increase purging pressure and provide a favorable optical environment for laser transmission.

The embodiments disclosed herein may reduce both laser disruption and dissipation within a wellbore, as the reduced clearance may limit exposure of the laser beam to debris and unfavorable optical environments. Accordingly, the embodiments disclosed herein may enable the use of a slim laser subsurface tool that can access deep perforation targets with small wellbore restrictions. Further, through the reduced clearance, lower pumping rates may be used for a purging fluid to clear the path of the laser beam and improve the optical environment in front of the lens when compared to conventional tooling and methods where a standard clearance is defined. Embodiments disclosed herein may include a plurality of sealing components for providing a sealed environment within the slim laser subsurface tool. These sealing components may include a lens capping off the telescoping laser head as well as one or more seals generated between nested segments of the telescoping laser head. The sealed environment may be filled with the purging fluid to provide an extended optimal environment for laser transmission via the purging fluid filling the extended telescoping laser head.

FIG. 1 is a schematic side view of an example system 100 for subsurface laser perforation within a wellbore 102, according to at least one embodiment of the present disclosure. The wellbore 102 may include a target layer 104 within an inner circumference of the wellbore 102. The target layer 104 may be a portion of a metal casing, a cement sheath, or the rock structure through which the wellbore 102 is defined. The system 100 may include a slim laser subsurface tool 106 conveyable into the wellbore 102 and operable to perforate the target layer 104.

As illustrated, the slim laser subsurface tool 106 may include a body 108 operatively coupled to a tubing 110, on which the slim laser subsurface tool 106 may be lowered within the wellbore 102. In some embodiments, the tubing 110 may be coiled tubing deployed from a surface location (e.g., the surface location 124) to include any necessary wiring or piping for operating the slim laser subsurface tool 106.

The body 108 may support a telescoping laser head 112 at a forward end thereof. The telescoping laser head 112 may be operable to fire a laser beam 114 toward the target layer 104. The telescoping laser head 112 may include a plurality of nested segments 116 which are translatable between an extended state, as illustrated in FIG. 1, and a retracted state (see FIG. 3B) in which each of the nested segments 116 is substantially contained within an interior of the body 108. The plurality of nested segments 116 may be extended from the body 108 during the perforation operation to create a reduced clearance 118 between the telescoping laser head 112 and the target layer 104. In contrast, when the telescoping laser head 112 is in the retracted state, a larger clearance 120 may be defined between the telescoping leaser head 112 and the target layer 104. The larger clearance 120 may be representative of a clearance that is created when using conventional slim laser perforation tools (not shown) without a telescoping laser head 112, where a laser beam is emitted directly from a body of the conventional slim laser perforation tool. The larger clearance 120 may be far greater than the reduced clearance 118 of the illustrated embodiment. Operation of a conventional slim laser tool across the larger clearance 120 may require extensive purging and increased power to counteract power loss and dissipation of the laser beam 114 during transmission through a wellbore fluid. In the illustrated embodiment, the reduced clearance 118 may limit power loss and dissipation of the laser beam 114, such that reduced power levels and purging may be sufficient to operate the slim laser subsurface tool 106.

The slim laser subsurface tool 106 may further include one or more purging nozzles 122 at or near a distal, forward or output end of the telescoping laser head 112. The purging nozzles 122 may emit a purging fluid, such as a nitrogen gas, therethrough. The purging nozzles 122 may be oriented such that the purging fluid is directed towards the laser beam 114 during perforation operations. The purging nozzles 122 may use the purging fluid to clear any debris away from the laser beam 114 as the target layer 104 is perforated. Further, the purging fluid emitted through the purging nozzles 122 may create an optically favorable environment through which the laser beam 114 may pass (traverse) without significant dissipation or power loss.

To effectively clear a path for the laser beam 114, a lower pressure or flowrate of purging fluid may be provided through the nozzles 122 in comparison to conventional laser perforation tools, as the size of the reduced clearance 118 may reduce the exigency of purging. However, with the addition of the purging nozzles 122, the slim laser subsurface tool 106 may further reduce power consumption and may include a tool diameter smaller than conventional laser perforation tools. The slim laser subsurface tool 106 may be utilized in forming perforations at deeper depths of the wellbore 102 though the target layer 104 and any substrate 123 behind the target layer 104, including cement sheaths or rock formations. In some well completions, smaller diameter openings or restrictions "R" above the targeted layer 104 may preclude the use of conventional laser perforation tools, which could fit closely within the targeted layer. As such, the slim laser subsurface tool 106 may enter into these smaller diameter openings, while the telescoping laser head 112 may reduce the clearance 120 to the reduced clearance 118 to reduce power loss.

The system 100 may include a source for both the laser beam 114 and a purging fluid at a surface location 124. In some embodiments, the surface location 124 may be positioned directly above the wellbore 102, and may incorporate a wellhead (not shown) for the wellbore 102. In further embodiments, however, the surface location 124 may be located any distance from the wellbore 102 and be communicatively coupled to the tubing 110 with appropriate surface conduits and cables (not shown). The surface location 124 may include a laser source 126, which may be trailer- or truck-mounted for rapid deployment. The laser source 126 may be operably coupled to a fiber optic cable 128 that may be run through the tubing 110 to reach the body 108. The laser source 126 may produce laser energy to be fired from the telescoping laser head 112 as the laser beam 114.

The surface location 124 may further include a purging fluid source 130 operatively coupled to a purging pump 132. In some embodiments, the purging fluid source 130 may be a pressurized fluid tank transportable to the surface location 124 as needed. The purging pump 132 may be in fluid communication with the purging fluid source 130 and a fluid line 134 that may provide the purging fluid into the tubing 110. The tubing 110 may then carry the purging fluid directly to the body 108 and/or the purging nozzles 122. The purging pump 132 may be operable to provide the purging fluid at high-pressures to the body 108.

Figure 2:
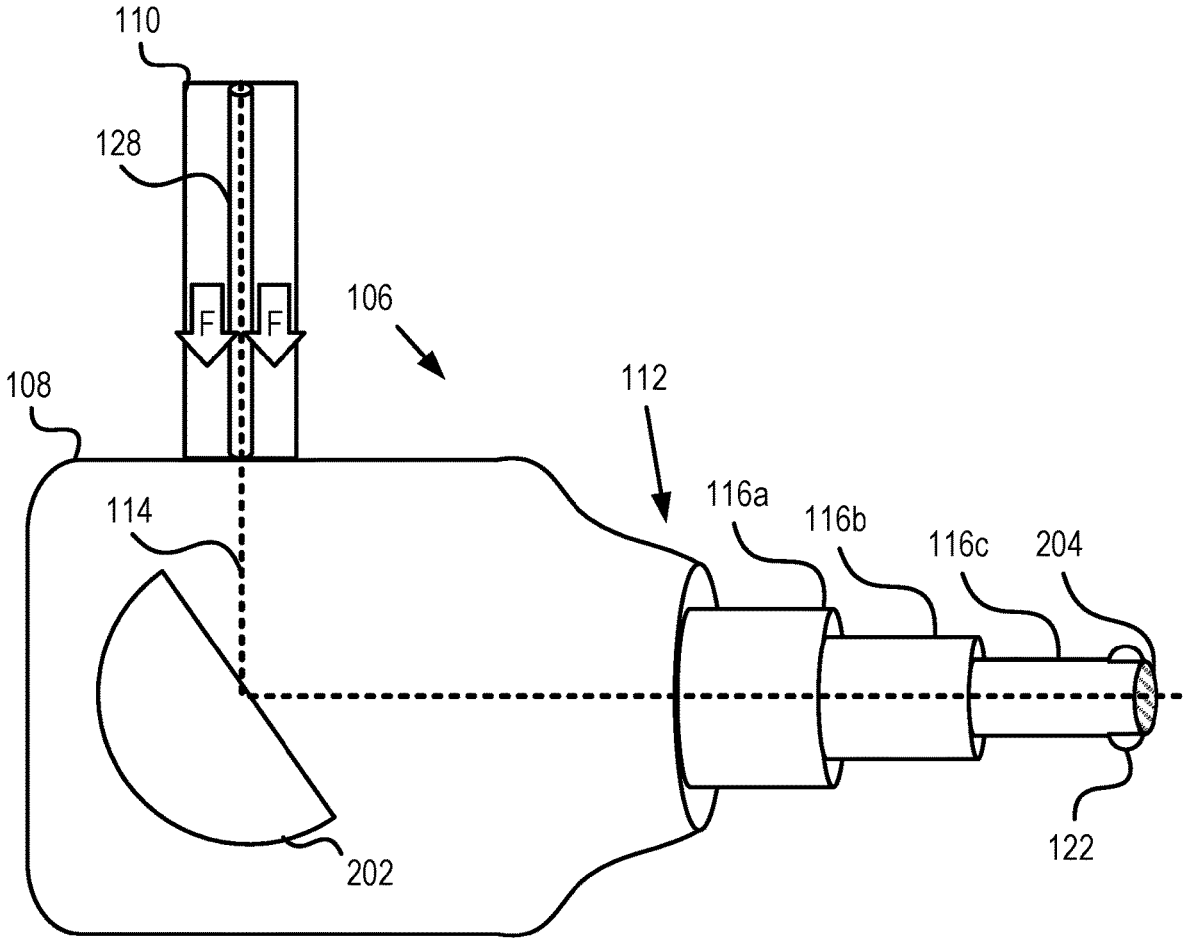
FIG. 2 is a schematic cross-sectional side view of the subsurface laser tool illustrated with a telescoping laser head in an extended state, according to at least one embodiment of the present disclosure.

FIG. 2 is a schematic side view of the slim laser subsurface tool 106 with the telescoping laser head 112 in the extended state, according to at least one embodiment of the present disclosure. In the illustrated embodiment, the telescoping laser head 112 includes a first nested segment 116*a*, a second nested segment 116*b*, and a third nested segment 116*c* extended from the body 108. The nested segments 116*a-c* may define a flowpath within the telescoping laser head 112 through which the laser beam 114 may travel in a controlled environment.

The body 108 may be operatively coupled to the tubing 110, wherein the tubing 110 includes both the fiber optic cable 128 and the fluid line 134. Further, the body 108 may be rotationally coupled to the tubing 110, such that any rotation applied to the tubing 110 (e.g., at the surface location 124) may directly rotate the body 108 within the wellbore 102 (FIG. 1). In further embodiments, however, the body 108 may include a rotational assembly (not shown) to enable independent and selective rotation of the slim laser subsurface tool 106 without rotation of the tubing 110. Coupling the tubing 110 to the body 108 may provide energy for the laser beam 114, as well as the purging fluid for the purging nozzles 122.

As depicted in FIG. 2, the laser beam 114 may exit the fiber optic cable 128 towards a reflector 202 installed within the body 108. The reflector 202 may be fixed at a predetermined angle to aim (redirect) the laser beam 114 towards the telescoping laser head 112. The reflector 202 may aim the laser beam 114 through the telescoping laser head 112 and toward a target (e.g., target layer 104 of FIG. 1).

In the illustrated embodiment, the third nested segment 116*c* (the smallest nested segment) supports a lens 204 installed at an output end of the telescoping laser head 112, and through which the laser beam 114 may travel. In some embodiments, the lens 204 may be selected to focus the laser beam 114 at a desired intensity, beam width, or to provide any further tuning of the laser beam 114 before perforation. Further, the lens 204 may be sealingly engaged with the third nested segment 116*c*, such that the lens 204 may separate an interior of the slim laser subsurface tool 106 from the ambient environment of the wellbore 102. As such, in combination with the purging nozzles 122, the lens 204 may further aid in maintaining a clear path for the laser beam 114 during the perforation operation.

The tubing 110 may directly provide the purging fluid into the body 108 and towards the telescoping laser head 112 and the purging nozzles 122 thereon. In the illustrated embodiment, the purging fluid "F" is transported through an annulus within the tubing 110 defined between an interior wall of the tubing 110 and the fiber optic cable 128. The purging fluid F may flow through the telescoping laser head 112 and directly into the purging nozzles 122 from inside the third nested segment 116*c*. As such, the body 108 and the telescoping laser head 112 may be filled with the purging fluid F during the perforation operation. Accordingly, the purging fluid F may be chosen for optically favorable properties to prevent disruption or dissipation of the laser beam 114 as it travels therethrough.

Figure 3A:
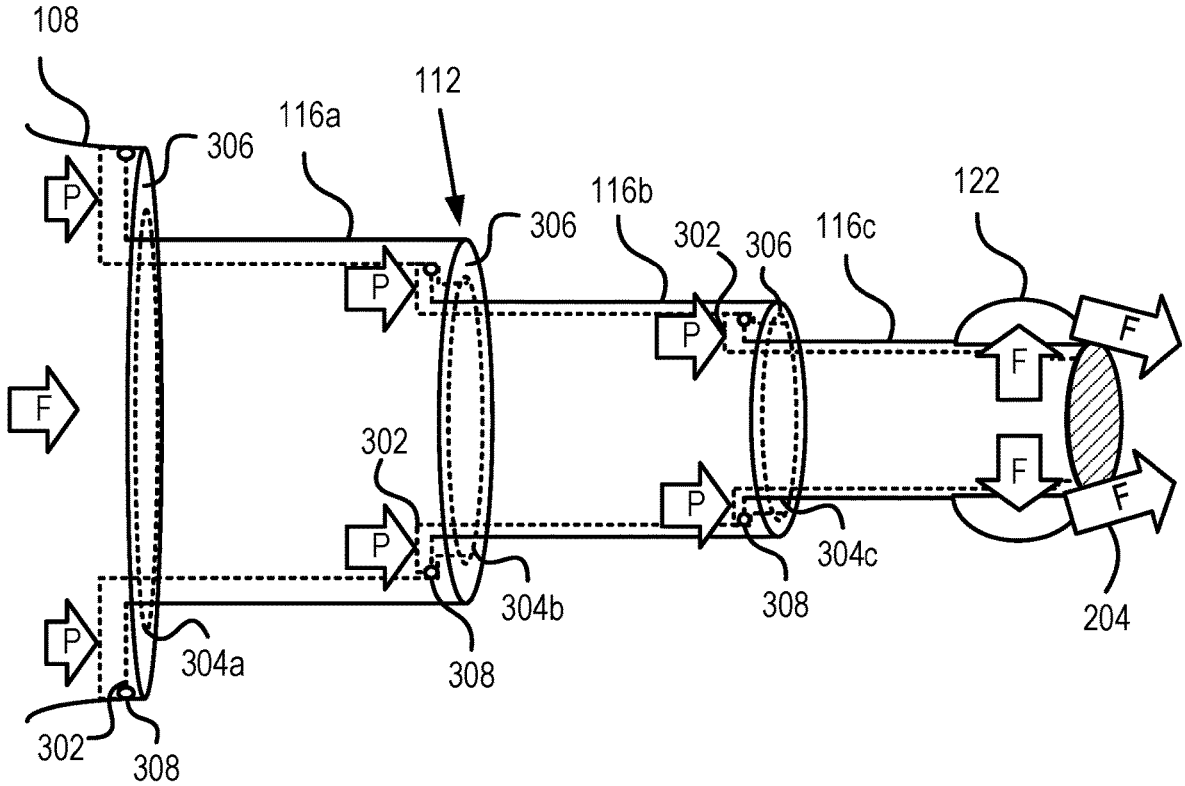
FIGS. 3A and 3B are schematic side views of the telescoping laser head in the extended state and a retracted state, respectively, according to at least one embodiment of the present disclosure.

FIG. 3A is a schematic side view of the telescoping laser head 112 in the extended state, according to at least one embodiment of the present disclosure. As discussed above, the nested segments 116*a-c* may be expandable (extendable, telescoping, etc.) and retractable with respect to the body 108 to control a length of the telescoping laser head 112 prior to, subsequent to, or during perforation. Each nested segment 116*a-c* may include a plunger section 302 nested within either an adjacent nested segment 116*a-b* or the body 108. Each nested segment 116*a-c* and the body 108 may further define an aperture 304*a-c* within an end opposing the plunger section 302, such that a further (adjacent) nested segment 116*a-c* may be inserted to assemble the telescoping laser head 112. Each aperture 304 may be defined such that a lip 306 is formed around each aperture 304. Each lip 306 may protrude inward to act as a stopper (stop shoulder) for the plunger section 302 of a smaller nested segment 116*a-c* during extension to prevent extending out of the telescoping laser head 112.

In some embodiments, the plunger section 302 may include a sealing component 308, such as a rubberized gasket or O-ring, around the plunger section 302 and sealingly engaged with an interior of a corresponding nested segment 116*a-c* or body 108. The sealing component 308 may prevent fluid flow through or around the plunger section 302 and may maintain a sealed environment within the telescoping laser head 112. Further, as discussed above, the third nested segment 116*c* may support a lens 204 which may cover the aperture 304 in the third nested segment 116*c* to maintain a sealed environment within the telescoping laser head 112 during operation. While the lens 204 is depicted within the third nested segment 116*c*, those skilled in the art will readily appreciate that any number of nested segments 116*a-c* may be included in the telescoping laser head and that the lens 204 may be included within a smallest (distal-most) nested segment 116, without departing from the scope of this disclosure.

In at least one embodiment, the expansion (extension) of the telescoping laser head 112 may be hydraulically/pneumatically controlled using the purging fluid "F" from the tubing 110. The purging fluid "F" will continue to flow through the nested segments 116*a-c* and a pressure "P" may build in the telescoping laser head 112. As the pressure "P" builds within the telescoping laser head 112, the plunger section 302 of the third nested segment 116*c* may translate towards the lip 306 of the second nested segment 116*b*. The plunger section 302 and the third nested segment 116*c* may translate forward (radially outward) until the plunger section 302 stops against an interior of the lip 306 of the second nested segment 116*b* and the third nested segment 116*c* is fully extended, as depicted in FIG. 3A.

Pressure "P" may continue to increase within the telescoping laser head 112 following translation of the third nested segment 116*c*, such that the plunger section 302 of the second nested segment 116*b* begins to translate. The process may continue with full extension of the second nested segment 116*b* and the first nested segment 116*a*, until the telescoping laser head 112 is in a fully extended state. In some embodiments, friction between each of the nested segments 116*a-c* and the body 108 may control the extension of the nested segments 116*a-c*, as the pressure "P" acts upon the component with the least friction or resistance first. During this process, the purging nozzles 122 may be aimed to emit the purging fluid "F" in front of the lens 204 and into the path of the laser beam 114 of FIGS. 1 and 2. In some embodiments, the purging fluid "F" may be pumped through the tubing 110 at a sufficient flowrate to enable extension of the telescoping laser head 112 while simultaneously emitting (discharging) the purging fluid "F". In further embodiments, however, operation of the purging nozzles 122 may include one or more control valves (not shown) to prevent emission (discharge) until the telescoping laser head 112 is fully extended. In these embodiments, the pressure "P" may be large enough to passively emit the purging fluid "F" through the purging nozzles 122.

Figure 3B:
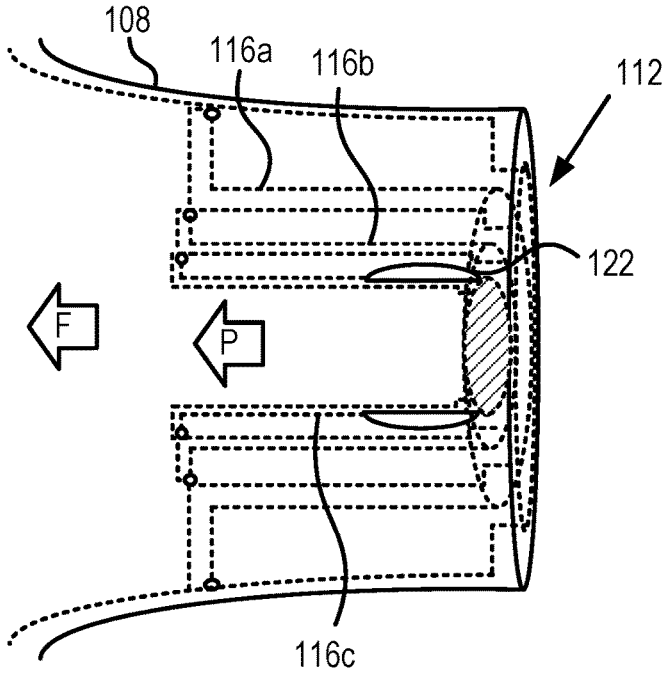

FIG. 3B is a schematic side view of the telescoping laser head 112 in a retracted state, according to at least one embodiment of the present disclosure. As discussed above, the nested segments 116*a-c* may be expandable (extendible) and retractable with respect to the body 108 to control a length of the telescoping laser head 112 prior to, subsequent to, or during perforation. Following perforation operations, the telescoping laser head 112 may be retracted to be safely removed from the operating environment (e.g., the wellbore 102 of FIG. 1). In some embodiments, the retraction of the telescoping laser head 112 may be performed hydraulically/pneumatically through a suction or negative pressure. In these embodiments, the tubing 110 may extract the purging fluid "F" from the telescoping laser head 112 and body 108. In further embodiments, the tubing 110 may cease any flow therethrough while the purging nozzles 122 continue to emit or vent purging fluid "F" out of the telescoping laser head 112. In either of these embodiments, the reduction of the quantity of purging fluid "F" within the telescoping laser head 112 may reverse direction of the pressure "P" in the sealed environment of the telescoping laser head 112. As such, the plunger sections 302 may be drawn back towards the body 108 and the telescoping laser head 112 may begin to retract under the external pressure applied by the wellbore fluid. However, in further embodiments, the extension and retraction of the telescoping laser head 112 may be performed mechanically, such that motorized or spring-biased control of the telescoping laser head 112 is utilized.

Figure 4:
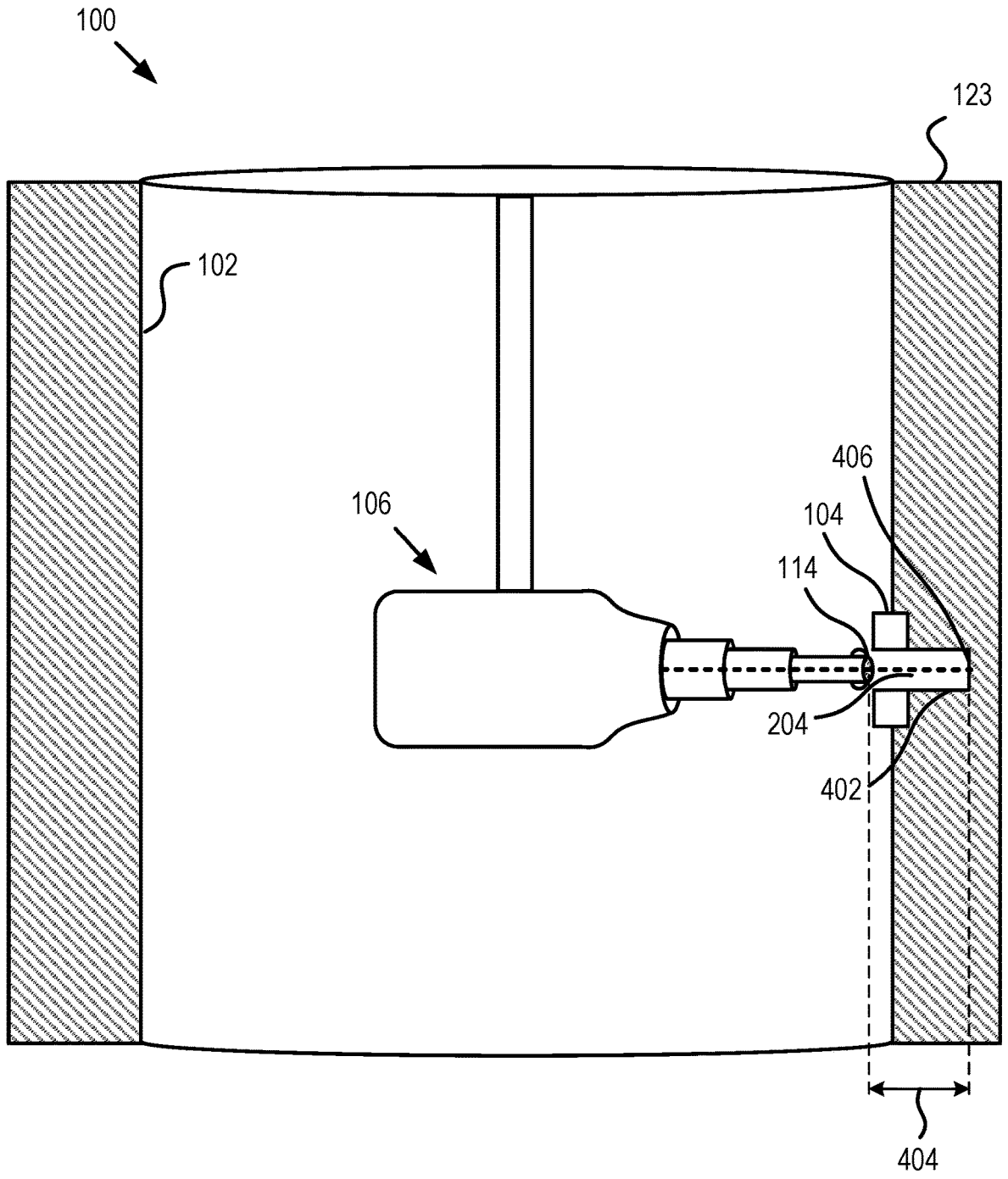
FIG. 4 is a schematic side view of the system employed in a deep perforation operation, according to at least one embodiment of the present disclosure.

FIG. 4 is a schematic side view of the system 100 with the slim laser subsurface tool 106 disposed within the wellbore 102 in a deep perforation operation, according to at least one embodiment of the present disclosure. In the illustrated embodiment, the target layer 104 may be penetrated, and the substrate 123 behind the target layer 104 may be further targeted or perforated through. The telescoping laser head 112 may accordingly extend toward the perforation 402 to maintain a reduced clearance 404 between the lens 204 and the perforated surface 406.

Figure 5:
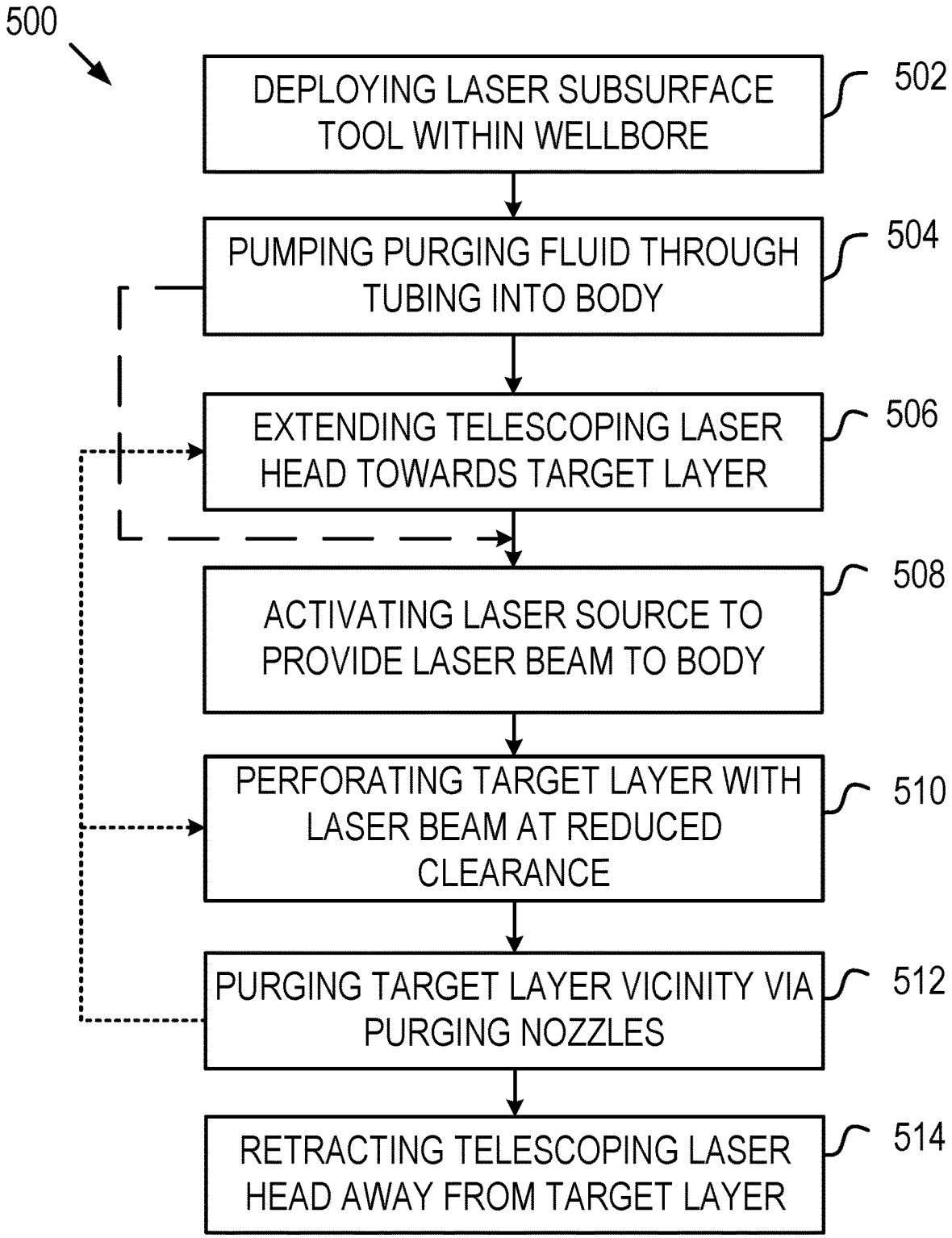
FIG. 5 is a flowchart for an example method for subsurface laser perforation within a wellbore, according to at least one embodiment of the present disclosure.

FIG. 5 is a flowchart for an example method 500 for subsurface laser perforation within a wellbore, according to at least one embodiment of the present disclosure. The method 500 may be implemented by the system 100 and slim laser subsurface tool 106 of FIGS. 1-4. Thus, reference can be made to the example of FIGS. 1-4 and the example of FIG. 5. The method 500 may begin at 502 with deploying a slim laser subsurface tool (e.g., the slim laser subsurface tool 106) within a wellbore to be perforated (e.g., the wellbore 102). In some embodiments, the slim laser subsurface tool may be deployed within the wellbore on a tubing (e.g., the tubing 110), which may be a coiled tubing, and which may include one or more conduits therein. The slim laser subsurface tool may include a body (e.g., the body 108) with a telescoping laser head (e.g., the telescoping laser head 112) included therein.

The method 500 may continue at 504 with pumping a purging fluid (e.g., the purging fluid "F") through the tubing into the body. The tubing may interface with a fluid line (e.g., the fluid line 134) to provide the purging fluid from an external source (e.g., the purging fluid source 130) into the tubing. In some embodiments, a purging pump (e.g., the purging pump 132) may interpose the purging fluid source and the fluid line, and may provide the pressure or flowrate to the tubing and into the body.

The method 500 may continue at 506 with extending the telescoping laser head towards a target layer (e.g., the target layer 104) to be perforated. In the illustrated embodiment, the laser head is extended at 506 via hydraulic or pneumatic actuation provided by the purging fluid pumped at 504. The purging fluid introduced at 504 may increase a pressure (e.g., the pressure "P") within the telescoping laser head, such that a plurality of nested segments (e.g., the nested segments 116*a-c*) are extended from the body. The plurality of nested segments may include internal plunger sections (e.g., plunger sections 302) which may travel forward and backward (e.g., radially outward and inward) to extend and retract. The pressure may act upon the internal plunger sections to provide a translating force and extend each nested segment. In alternate embodiments, however, the telescoping laser head may be extended and retracted via mechanical means, such as an electric motor. In these embodiments, the pumping of the purging fluid at 504 may be performed after extending the telescoping laser head at 506. Regardless of the means of extension utilized, extending the telescoping laser head may create a reduced clearance (e.g., the reduced clearance 118) between the telescoping laser head and the target layer. In some embodiments, the pressure inside the body may be increased as other steps of the method 500 are performed, e.g., step 510 (described below) to maintain the reduced clearance as the depth of a perforation is increased.

The method 500 may continue at 508 with activating a laser source (e.g., the laser source 126) to provide a laser beam (e.g., the laser beam 114) to the body. An optical fiber cable (e.g., the fiber optic cable 128) may be in communication with the laser source and the body, and may provide the laser beam to the laser head through the tubing, as discussed above. In at least one embodiment, the body may include or support a reflector (e.g., the reflector 202) therein to redirect the laser beam towards the telescoping laser head. The laser beam may travel through the body and telescoping laser head to be output through a lens (e.g., the lens 204) at an end of the telescoping laser head. The lens may further focus or alter the laser beam in some embodiments, and in other embodiments, the lens may be only protective, further isolating an interior of the telescoping laser head from the wellbore environment, without altering the laser beam. The interior of the telescoping laser head may be filled with the purging fluid, such that an optically-favorable environment is created. As such, any disruption or dissipation of the laser beam may be reduced within the telescoping laser head, particularly when compared to the wellbore environment exterior to the body.

The method 500 may continue at 510 with perforating the target layer with the laser beam at the reduced clearance previously created. The laser beam may penetrate and remove the target layer through fragmentation, melting, vaporization, or a combination thereof to create a perforation (e.g., the perforation 402) within the target layer and/or a substrate (e.g., the substrate 123) behind the target layer. The perforation may extend deeper through the target layer and/or substrate as the laser beam continues to melt and vaporize any material in the path of the laser beam. Through the reduced clearance, any loss of power and dissipation of the laser beam may be accordingly reduced, and efficiency of the laser perforation may be increased. The method 500 may continue at 512 with purging a vicinity of the target layer with one or more purging nozzles (e.g., purging nozzles 122) at or near the lens. The one or more purging nozzles may emit the purging fluid directionally towards the path of the laser beam to create a favorable optical environment while further pushing debris away from the laser beam and telescoping laser head. The purging nozzles may be manually controlled, or may include a pressure control valve, a flow control valve or other mechanism to autonomously discharge the purging fluid as the pressure within the telescoping laser head increases past a purging threshold. The purging of the target layer vicinity at 512 may be performed simultaneously to the perforation at 510, or may be cyclically performed in rapid succession.

Once a desired perforation depth is reached via the laser beam (e.g., after reaching a sufficient depth to permit hydrocarbons from a hydrocarbon reservoir to flow into the wellbore) the method 500 may continue at 514 with retracting the telescoping laser head away from the target layer. The retraction of the telescoping laser head may be performed mechanically, or may be actuated hydraulically through suction or a reverse pressure In further embodiments, the purging pump may be deactivated to prevent further flow of purging fluid into the body. In these embodiments, the purging nozzles may continue to emit the purging fluid to drain the body. As the body is drained of purging fluid, the purging pressure may cause the nested segments to retract towards the body. Following retraction of the telescoping laser head, the slim laser subsurface tool may be removed from the wellbore, or may be relocated therein for further subsurface perforation.

Embodiments disclosed herein include:

A. A system for performing subsurface laser perforation, the system comprising a tubing deployed within a wellbore including a target layer for perforation, the tubing in communication with a surface location, and a slim laser subsurface tool operatively coupled to the tubing, the laser subsurface tool including a body coupled to the tubing, a telescoping laser head disposed within the body and including a plurality of nested segments, a smallest of the plurality of nested segments defining an orifice at an output end of the telescoping laser head, and a lens supported by the smallest of the plurality of nested segments and covering the orifice at the output end.

B. A method for subsurface laser perforation, the method comprising deploying, via a tubing, a slim laser subsurface tool within a wellbore including a target layer to be perforated, extending a telescoping laser head from a body of the slim laser subsurface tool towards the target layer within the wellbore to generate a reduced clearance between a lens supported at an output end of the telescoping laser head, activating a laser source to transmit a laser beam through the body, telescoping laser head, and lens, perforating the target layer with the laser beam transmitted through the lens and across the reduced clearance, and purging a pathway across the reduced clearance by discharging a purging fluid through one or more purging nozzles defined in the telescoping laser head.

C. A slim laser subsurface tool for laser perforation in a wellbore, the slim laser subsurface tool comprising a body for coupling to a tubing extendable within the wellbore, and a telescoping laser head selectively extendable from the body and operable to receive and output a laser beam, the telescoping laser head including a plurality of nested segments movable with respect to the body to extend and retract the telescoping laser head, a lens disposed at an output end of the telescoping laser head defined in a smallest one of the plurality of nested segments, and one or more purging nozzles disposed at the output end and operable to receive a purging fluid and to discharge the purging fluid in front of the lens.

Each of embodiments A through C may have one or more of the following additional elements in any combination: Element 1: wherein the tubing is fluidly coupled between a purging fluid source and the body, and wherein the telescoping laser head is extendable in response to an increase of purging fluid in the body. Element 2: wherein the nested segments each include a plunger section operable to extend or retract each nested segment when subjected to a purging pressure by the purging fluid. Element 3: wherein the smallest of the plurality of nested segments includes one or more purging nozzles at or near the lens, and wherein the purging nozzles are operable to emit the purging fluid in front of the lens. Element 4: wherein each plunger section includes a sealing component sealingly engaged with an interior of an adjacent one of the nested segments or the body. Element 5: wherein the system includes a fluid line in communication with the purging fluid source and the tubing. Element 6: further including a purging pump interposing the purging fluid source and the fluid line, the purging pump operable to provide pressure or suction to the fluid line. Element 7: wherein the laser source is disposed at a surface location and the wherein the laser source is optically coupled to the body by a fiber optic cable extending along the tubing and operable to emit a laser beam into the body. Element 8: further comprising a reflector disposed within the body and angularly positioned to redirect a laser beam from the fiber optic cable towards the telescoping laser head. Element 9: wherein the lens forms a seal within the orifice at the output end to isolate an interior of the body from an ambient environment of the wellbore.

Element 10: wherein the wellbore includes one or more restrictions above the target layer, the one or more restrictions having a reduced diameter with respect to the target layer. Element 11: further comprising: pumping the purging fluid through the tubing and into the body and telescoping laser head. Element 12: wherein extending the telescoping laser head further includes: pumping the purging fluid within the body and/or the telescoping laser head to increase the purging pressure and translate one or more nested segments of the telescoping laser head towards the target layer. Element 13: further comprising: retracting the telescoping laser head away from the target layer to move the laser subsurface tool to a retracted state. Element 14: wherein retracting the telescoping laser head includes: reducing the purging pressure within the body and/or telescoping laser head to translate one or more nested segments of the telescoping laser head away from the target layer. Element 15: wherein the tubing provides the purging fluid directly into an interior of the body. Element 16: each of the plurality of nested segments including: a plunger section operable to extend the nested segment when acted on by a purging pressure generated by the purging fluid on the interior of the body and telescoping laser head. Element 17: wherein each of the plurality of nested segments and the body define an aperture sized to receive an adjacent one of the nested segments or the lens.

By way of non-limiting example, exemplary combinations applicable to A through C include: Element 1 with Element 2; Element 2 with Element 3; Element 2 with Element 4; Element 1 with Element 5; Element 5 with Element 6; Element 7 with Element 8; Element 8 with Element 9; Element 7 with Element 10; Element 11 with Element 12; Element 13 with Element 14; Element 15 with Element 16; and Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A system for performing subsurface laser perforation, the system comprising:

a tubing extending from and in communication with a surface location and arranged within a wellbore including a target layer for perforation; and a slim laser subsurface tool operatively coupled to the tubing and including:

a body coupled to the tubing;

a telescoping laser head disposed within the body and including a plurality of nested segments, a smallest of the plurality of nested segments defining an orifice at a furthest distal end thereof; and a lens supported by the smallest of the plurality of nested segments and covering the orifice at the furthest distal end.

2. The system of claim 1, wherein the tubing is fluidly coupled between a purging fluid source and the body, and wherein pumping the purging fluid into the body causes the telescoping laser head to extend.

3. The system of claim 2, wherein the nested segments each include a plunger section operable to extend or retract each nested segment when subjected to a purging pressure by the purging fluid.

4. The system of claim 3, further comprising one or more purging nozzles included on the smallest of the plurality of nested segments at or near the lens, the one or more purging nozzles being operable to emit the purging fluid in front of the lens.

5. The system of claim 3, wherein each plunger section includes a sealing component sealingly engaged with an interior of an adjacent one of the plurality of nested segments or the body.

6. The system of claim 2, further comprising a fluid line in communication with the purging fluid source and the tubing.

7. The system of claim 6, further comprising a purging pump interposing the purging fluid source and the fluid line, the purging pump being operable to provide pressure or suction to the fluid line.

8. The system of claim 1, wherein a laser source is disposed at a surface location and the laser source is optically coupled to the body by a fiber optic cable extending along the tubing and operable to emit a laser beam into the body.

9. The system of claim 8, further comprising a reflector disposed within the body and angularly positioned to redirect a laser beam from the fiber optic cable towards the telescoping laser head.

10. The system of claim 9, wherein the lens forms a seal within the orifice at the output end to isolate an interior of the body from an ambient environment of the wellbore.

11. The system of claim 8, wherein the slim laser subsurface tool is sized to pass through a restriction with a diameter of about 2½ inches.

12. A method for subsurface laser perforation, the method comprising:

deploying, via a tubing, a slim laser subsurface tool within a wellbore including a target layer to be perforated;

extending a telescoping laser head from a body of the slim laser subsurface tool towards the target layer within the wellbore and thereby generating a reduced clearance between a lens supported at a furthest distal end of a smallest nested segment of the telescoping laser head and the target layer;

activating a laser source to transmit a laser beam through the body, the telescoping laser head, and the lens;

perforating the target layer with the laser beam transmitted through the lens and across the reduced clearance; and purging a pathway across the reduced clearance by discharging a purging fluid through one or more purging nozzles provided on the telescoping laser head.

13. The method of claim 12, further comprising pumping the purging fluid through the tubing and into the body and telescoping laser head.

14. The method of claim 13, wherein extending the telescoping laser head further comprises:

pumping the purging fluid within the body and/or the telescoping laser head and thereby increasing a purging pressure; and moving one or more nested segments of the telescoping laser head towards the target layer with the purging pressure.

15. The method of claim 12, further comprising retracting the telescoping laser head away from the target layer to move the laser subsurface tool to a retracted state.

16. The method of claim 15, wherein retracting the telescoping laser head comprises reducing the purging pressure within the body and/or telescoping laser head and thereby causing one or more nested segments of the telescoping laser to move head away from the target layer.

17. A slim laser subsurface tool for laser perforation in a wellbore, the slim laser subsurface tool comprising:

a body for coupling to a tubing extendable within the wellbore; and a telescoping laser head selectively extendable from the body and operable to receive and output a laser beam, the telescoping laser head including:

a plurality of nested segments movable with respect to the body to extend and retract the telescoping laser head;

a lens disposed at a furthest distal end of a smallest one of the plurality of nested segments of the telescoping laser head; and one or more purging nozzles disposed at the output end and operable to receive a purging fluid and to discharge the purging fluid in front of the lens.

18. The laser subsurface tool of claim 17, wherein the tubing conveys the purging fluid directly into an interior of the body.

19. The laser subsurface tool of claim 18, wherein each nested segment includes a plunger section operable to extend the nested segment when acted on by a purging pressure generated by the purging fluid on the interior of the body and telescoping laser head.

20. The laser subsurface tool of claim 19, wherein each nested segment and the body each define an aperture sized to receive an adjacent one of the nested segments or the lens.

* * * * *